US009813835B2

(12) United States Patent
Christoph

(10) Patent No.: US 9,813,835 B2
(45) Date of Patent: Nov. 7, 2017

(54) SOUND SYSTEM FOR ESTABLISHING A SOUND ZONE

(71) Applicant: Harman Becker Automotive Systems GmbH, Karlsbad (DE)

(72) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 50 days.

(21) Appl. No.: 14/946,450

(22) Filed: Nov. 19, 2015

(65) Prior Publication Data

US 2016/0142852 A1 May 19, 2016

(30) Foreign Application Priority Data

Nov. 19, 2014 (EP) ..... 14193885

(51) Int. Cl.
*H04R 5/02* (2006.01)
*H04S 7/00* (2006.01)
(Continued)

(52) U.S. Cl.
CPC ..... *H04S 7/303* (2013.01); *H04R 5/02* (2013.01); *H04R 5/04* (2013.01); *H04S 7/305* (2013.01);
(Continued)

(58) Field of Classification Search
CPC ..... H04S 7/303; H04S 7/305; H04S 2420/01; H04S 2400/11; H04S 2400/09;
(Continued)

(56) References Cited

U.S. PATENT DOCUMENTS 8,165,310 B2 4/2012 Christoph et al.
8,184,828 B2 5/2012 Christoph
(Continued)

FOREIGN PATENT DOCUMENTS

EP 2806663 A1 11/2014
EP 2806664 A1 11/2014
(Continued)

OTHER PUBLICATIONS

William G Gardner, "3-D Audio Using Loudspeakers," Sep. 1997, Massachusetts Institute of Technology, pp. 1-153, Retrieved from the Internet: http://sound.media.mit.edu/Papers/gardner_thesis.pdf (via IDS).*

(Continued)

*Primary Examiner* — Md S Elahee
*Assistant Examiner* — Sabrina Diaz
(74) *Attorney, Agent, or Firm* — Brooks Kushman P.C.

(57) ABSTRACT

A system and method for acoustically reproducing Q electrical audio signals and establishing N sound zones is provided. Reception sound signals occur that provide an individual pattern of the reproduced and transmitted Q electrical audio signals. The method includes processing the Q electrical audio signals to provide K processed electrical audio signals and converting the K processed electrical audio signals into corresponding K acoustic audio signals with K groups of loudspeakers that are arranged at positions separate from each other and within or adjacent to the N sound zones. The method further includes monitoring a position of a listener's head relative to a reference listening position. Each of the K acoustic audio signals is transferred according to a transfer matrix from each of the K groups of loudspeakers to each of the N sound zones to contribute to the corresponding reception sound signals.

17 Claims, 6 Drawing Sheets

(51) Int. Cl.
*H04R 5/04* (2006.01)
*H04R 3/12* (2006.01)
*H04S 3/02* (2006.01)

(52) U.S. Cl.
CPC ..... *H04R 3/12* (2013.01); *H04R 2499/13* (2013.01); *H04S 3/02* (2013.01); *H04S 2400/09* (2013.01); *H04S 2400/11* (2013.01)

(58) Field of Classification Search
CPC ..... H04S 3/02; H04S 3/002; H04S 1/002; H04R 5/02; H04R 5/04; H04R 5/00; H04R 2499/13; H04R 3/12; H04R 3/002; H04R 3/02
USPC ..... 381/302, 303, 300, 86
See application file for complete search history.

(56) References Cited

U.S. PATENT DOCUMENTS

| | | | |
|---|---|---|---|
| 8,712,068 | B2 | 4/2014 | Christoph |
| 2002/0090094 | A1 | 7/2002 | Amir et al. |
| 2011/0286614 | A1 | 11/2011 | Hess |

FOREIGN PATENT DOCUMENTS

| | | | |
|---|---|---|---|
| EP | 2816824 | A2 | 12/2014 |
| WO | 2013016735 | A2 | 1/2013 |
| WO | 2013101061 | A1 | 7/2013 |

OTHER PUBLICATIONS

Extended European Search Report for corresponding Application No. 14193885.2, dated May 21, 2015, 10 pages.
Wenzel et al., "Sound Lab: A Real-Time, Software-Based System for the Study of Spatial Hearing", AES 108th Convention, Paris, Feb. 19-22, 2000, 28 pages.
Gardner, "3-D Audio Using Loudspeakers", Massachusetts Institute of Technology, 1997, 154 pages.
Bauck et al., "Generalized Transaural Stereo and Applications", J. Audio Eng. Soc., vol. 44, No. 9, Sep. 1996, pp. 683-705.
European Office Action for Application No. 14 193 885, dated Mar. 23, 2017, 5 pages.

* cited by examiner

SOUND SYSTEM FOR ESTABLISHING A SOUND ZONE

CROSS-REFERENCE TO RELATED APPLICATIONS

This application claims priority to EP application Serial No. 14193885.2 filed Nov. 19, 2014, the disclosure of which is hereby incorporated in its entirety by reference herein.

TECHNICAL FIELD

This disclosure relates to a system and method (generally referred to as a "system") for processing a signal.

BACKGROUND

Spatially limited regions inside a space typically serve various purposes regarding sound reproduction. A field of interest in the audio industry is the ability to reproduce multiple regions of different sound material simultaneously inside an open room. This is desired to be obtained without the use of physical separation or the use of headphones, and is herein referred to as "establishing sound zones". A sound zone is a room or area in which sound is distributed. More specifically, arrays of loudspeakers with adequate preprocessing of the audio signals to be reproduced are of concern, where different sound material is reproduced in predefined zones without interfering signals from adjacent ones. In order to realize sound zones, it is necessary to adjust the response of multiple sound sources to approximate the desired sound field in the reproduction region. A large variety of concepts concerning sound field control have been published, with different degrees of applicability to the generation of sound zones.

SUMMARY

A sound system for acoustically reproducing Q electrical audio signals and establishing N sound zones is provided. Reception sound signals occur that provide an individual pattern of the reproduced and transmitted Q electrical audio signals. The sound system includes a signal processing arrangement that is configured to process the Q electrical audio signals to provide K processed electrical audio signals and K groups of loudspeakers that are arranged at positions separate from each other and within or adjacent to the N sound zones. Each being configured to convert the K processed electrical audio signals into corresponding K acoustic audio signals. The sound system further includes a monitoring system configured to monitor a position of a listener's head relative to a reference listening position. Each of the K acoustic audio signals is transferred according to a transfer matrix from each of the K groups of loud-speakers to each of the N sound zones to contribute to the corresponding reception sound signals. Processing of the Q electrical audio signals includes filtering that is configured to compensate for the transfer matrix so that each of the reception sound signals corresponds to one of the Q electrical audio signals. Characteristics of the filtering are adjusted based on the identified position of the listener's head.

A method for acoustically reproducing Q electrical audio signals and establishing N sound zones is provided. Reception sound signals occur that provide an individual pattern of the reproduced and transmitted Q electrical audio signals. The method includes processing the Q electrical audio signals to provide K processed electrical audio signals and converting the K processed electrical audio signals into corresponding K acoustic audio signals with K groups of loudspeakers that are arranged at positions separate from each other and within or adjacent to the N sound zones. The method further includes monitoring a position of a listener's head relative to a reference listening position. Each of the K acoustic audio signals is transferred according to a transfer matrix from each of the K groups of loudspeakers to each of the N sound zones to contribute to the corresponding reception sound signals. Processing of the Q electrical audio signals comprises filtering that is configured to compensate for the transfer matrix so that each one of the reception sound signals corresponds to one of the electrical audio signals. Characteristics of the filtering are adjusted based on the identified position of the listener's head.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following description and drawings. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
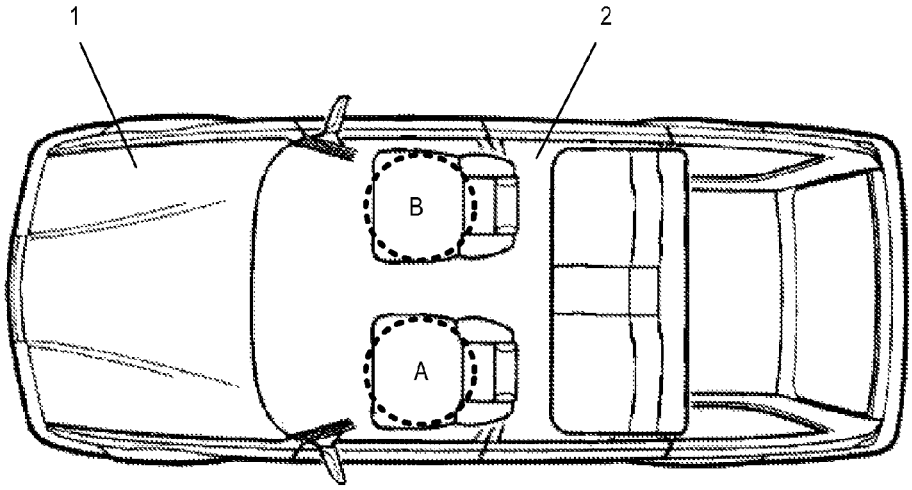
FIG. 1 is a top view of a car cabin with individual sound zones.

In referring to FIG. 1, individual sound zones (ISZ) in an enclosure such as cabin 2 of car 1 are shown, which includes in particular two different zones A and B. A sound program A is reproduced in zone A and a sound program B is reproduced in zone B. The spatial orientation of the two zones is not fixed and should adapt to a listener location and ideally be able to track the exact position in order to reproduce the desired sound program in the spatial region of concern. However, a complete separation of the sound fields found in each of the two zones (A and B) is not a realizable condition for a practical system implemented under reverberant conditions. Thus, it is to be expected that the listeners are subjected to a certain degree of annoyance that is created by adjacent reproduced sound fields.

Figure 2:
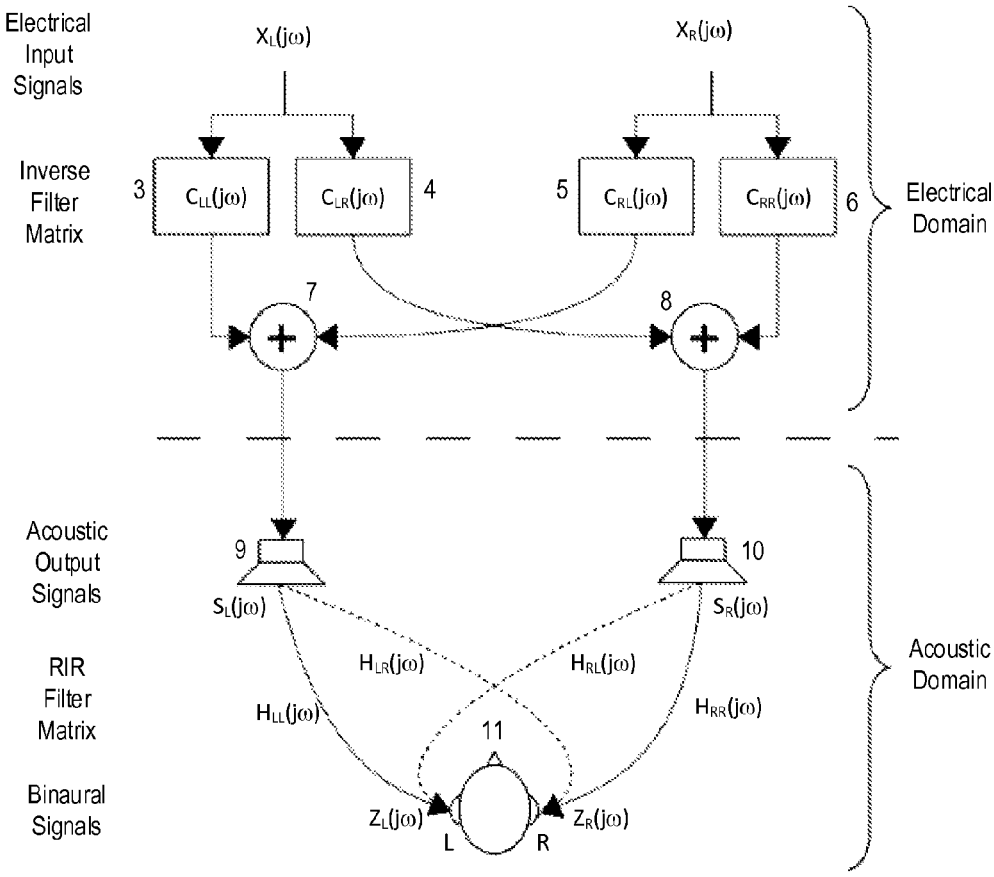
FIG. 2 is a schematic diagram illustrating a 2×2 transaural stereo system.

FIG. 2 illustrates a two-zone (e.g., a zone around left ear L and another zone around right ear R) transaural stereo system, i.e., a 2×2 system in which the receiving signals are binaural (stereo), e.g., picked up by the two ears of a listener or two microphones arranged on an artificial head at ear positions. The transaural stereo system of FIG. 2 is established around listener 11 from an input electrical stereo audio signal XL(jω), XR(jω) by way of two loudspeakers 9 and 10 in connection with an inverse filter matrix with four inverse filters 3-6 that have transfer functions CLL(jω), CLR(jω), CRL(jω) and CRR(jω) and that are connected upstream of the two loudspeakers 9 and 10. The signals and transfer functions are frequency domain signals and functions that correspond with time domain signals and functions. The left electrical input (audio) signal XL(jω) and the right electrical input (audio) signal XR(jω), which may be provided by any suitable audio signal source, such as a radio receiver, music player, telephone, navigation system or the like, are pre-filtered by the inverse filters 3-6. Filters 3 and 4 filter signal XL(jω) with transfer functions CLL(jω) and CLR(jω), and filters 5 and 6 filter signal XR(jω) with transfer functions CRL(jω) and CRR(jω) to provide inverse filter output signals. The in-verse filter output signals provided by filters 3 and 5 are combined by adder 7, and in-verse filter output signals provided by filters 4 and 6 are combined by adder 8 to form combined signals SL(jω) and SR(jω). In particular, signal SL(jω) supplied to the left loudspeaker 9 can be expressed as:

$$SL(j\omega)=CLL(j\omega)\cdot XL(j\omega)+CRL(j\omega)\cdot XR(j\omega), \quad (1)$$

and the signal SR(jω) supplied to the right loudspeaker 10 can be expressed as:

$$SR(j\omega)=CLR(j\omega)\cdot XL(j\omega)+CRR(j\omega)\cdot XR(j\omega). \quad (2)$$

Loudspeakers 9 and 10 radiate the acoustic loudspeaker output signals SL(jω) and SR(jω) to be received by the left and right ear of the listener, respectively. The sound signals actually present at listener 11's left and right ears are denoted as ZL(jω) and ZR(jω), respectively, in which:

$$ZL(j\omega)=HLL(j\omega)\cdot SL(j\omega)+HRL(j\omega)\cdot SR(j\omega), \quad (3)$$

$$ZR(j\omega)=HLR(j\omega)\cdot SL(j\omega)+HRR(j\omega)\cdot SR(j\omega). \quad (4)$$

In equations 3 and 4, the transfer functions Hij(jω) denote the room impulse response (RIR) in the frequency domain, i.e., the transfer functions from loudspeakers 9 and 10 to the left and right ear of the listener, respectively. Indices i and j may be "L" and "R" and refer to the left and right loudspeakers (index "i") and the left and right ears (index "j"), respectively.

The above equations 1-4 may be rewritten in matrix form, wherein equations 1 and 2 may be combined into:

$$S(j\omega)=C(j\omega)\cdot X(j\omega), \quad (5)$$

and equations 3 and 4 may be combined into:

$$Z(j\omega)=H(j\omega)\cdot S(j\omega), \quad (6)$$

wherein X(jω) is a vector composed of the electrical input signals, i.e., X(jω)=[XL(jω), XL(jω)]T, S(jω) is a vector composed of the loudspeaker signals, i.e., S(jω)=[SL(jω), SL(jω)]T, C(jω) is a matrix representing the four filter transfer functions CLL(jω), CRL(jω), CLR(jω) and CRR (jω) and H(jω) is a matrix representing the four room impulse responses in the frequency domain HLL(jω), HRL (jω), HLR(jω) and HRR(jω). Combining equations 5 and 6 yields:

$$Z(j\omega)=H(j\omega)\cdot C(j\omega)\cdot X(j\omega). \quad (6)$$

From the above equation 6, it can be seen that when:

$$C(j\omega)=H-1(j\omega)\cdot e-j\omega\tau, \quad (7)$$

in other words, the filter matrix C(jω) is equal to the inverse of the matrix H(jω) of room impulse responses in the frequency domain H−1(jω) plus an additionally delay τ (compensating at least for the acoustic delays), then the signal ZL(jω) arriving at the left ear of the listener is equal to the left input signal XL(jω) and the signal ZR(jω) arriving at the right ear of the listener is equal to the right input signal XR(jω), wherein the signals ZL(jω) and ZR(jω) are delayed as compared to the input signals XL(jω) and XR(jω), respectively. That is:

$$Z(j\omega)=X(j\omega)\cdot e-j\omega\tau. \quad (8)$$

As can be seen from equation 7, designing a transaural stereo reproduction system includes—theoretically—inverting the transfer function matrix H(jω), which represents the room impulse responses in the frequency domain, i.e., the RIR matrix in the frequency domain. For example, the inverse may be determined as follows:

$$C(j\omega)=\det(H)-1\cdot\mathrm{adj}(H(j\omega)), \quad (9)$$

which is a consequence of Cramer's rule applied to equation 7 (the delay is neglected in equation 9). The expression adj(H (jω)) represents the adjugate matrix of matrix H(jω). One can see that the pre-filtering may be done in two stages, wherein the filter transfer function adj(H (jω)) ensures a damping of the crosstalk and the filter transfer function det(H)−1 compensates for the linear distortions caused by the transfer function adj(H(jω)). The adjugate matrix adj(H(jω)) always results in a causal filter transfer function, whereas the compensation filter with the transfer function G(jω))=det(H)−1 may be more difficult to design.

In the example of FIG. 2, the left ear (signal ZL) may be regarded as being located in a first sound zone and the right ear (signal ZR) may be regarded as being located in a second sound zone. This system may provide a sufficient crosstalk damping so that, substantially, input signal XL is reproduced only in the first sound zone (left ear) and input signal XR is reproduced only in the second sound zone (right ear). As a sound zone is not necessarily associated with a listener's ear, this concept may be generalized and extended to a multi-dimensional system with more than two sound zones, provided that the system comprises as many loudspeakers (or groups of loudspeakers) as individual sound zones.

Referring again to the car cabin shown in FIG. 1, two sound zones may be associated with the front seats of the car. Sound zone A is associated with the driver's seat and sound zone B is associated with the front passenger's seat. When using four loudspeakers and two binaural listeners, i.e., four zones such as those at the front seats in the exemplary car cabin of FIG. 3, equations 6-9 still apply but yield a fourth-order system instead of a second-order system, as in the example of FIG. 2. The inverse filter matrix C(jω) and the room transfer function matrix H(jω) are then a 4×4 matrix.

As already outlined above, it needs some effort to implement a satisfying compensation filter (transfer function matrix $G(j\omega)=\det(H)-1=1/\det\{H(j\omega)\}$) of reasonable complexity. One approach is to employ regularization in order not only to provide an improved inverse filter, but also to provide maximum output power, which is determined by regularization parameter $\beta(j\omega)$. Considering only one (loudspeaker-to-zone) channel, the related transfer function matrix $G(j\omega k)$ reads as:

$$G(j\omega k)=\det\{H(j\omega k)\}/(\det\{H(j\omega k)\}^*\det\{H(j\omega k)\}+\beta(j\omega k)), \quad (10)$$

in which $\det\{H(j\omega k)\}=HLL(j\omega k)\ HRR(j\omega k)-HLR(j\omega k)\ HRL(j\omega k)$ is the gram determinant of the matrix $H(j\omega k)$, $k=[0, \ldots, N-1]$ is a discrete frequency index, $\omega k=2\pi kfs/N$ is the angular frequency at bin k, fs is the sampling frequency and N is the length of the fast Fourier transformation (FFT).

Regularization has the effect that the compensation filter exhibits no ringing behavior caused by high-frequency, narrow-band accentuations. In such a system, a channel may be employed that includes passively coupled midrange and high-range loudspeakers. Therefore, no regularization may be provided in the midrange and high-range parts of the spectrum. Only the lower spectral range, i.e., the range below corner frequency fc, which is determined by the harmonic distortion of the loudspeaker employed in this range, may be regularized, i.e., limited in the signal level, which can be seen from the regularization parameter $\beta(j\omega)$ that increases with decreasing frequency. This increase towards lower frequencies again corresponds to the characteristics of the (bass) loud-speaker used. The increase may be, for example, a 20 dB/decade path with common second-order loudspeaker systems. Bass reflex loudspeakers are commonly fourth-order systems, so that the increase would be 40 dB/decade. Moreover, a compensation filter designed according to equation 10 would cause timing problems, which are experienced by a listener as acoustic artifacts.

The individual characteristic of a compensation filter's impulse response results from the attempt to complexly invert $\det H(j\omega)$, i.e., to invert magnitude and phase despite the fact that the transfer functions are commonly non-minimum phase functions. Simply speaking, the magnitude compensates for tonal aspects and the phase compresses the impulse response ideally to Dirac pulse size. It has been found that the tonal aspects are much more important in practical use than the perfect inversion of the phase, provided the total impulse response keeps its minimum phase character in order to avoid any acoustic artifacts. In the compensation filters, only the minimum phase part of $\det H(j\omega)$, which is $hMin\phi$, may be inverted along with some regularization as the case may be.

Furthermore, directional loudspeakers, i.e., loudspeakers that concentrate acoustic energy to the listening position, may be employed in order to enhance the crosstalk attenuation. While directional loudspeakers exhibit their peak performance in terms of crosstalk attenuation at higher frequencies, e.g., >1 kHz, inverse filters excel in particular at lower frequencies, e.g., <1 kHz, so that both measures complement each other. However, it is still difficult to design systems of a higher order than 4×4, such as 8×8 systems. The difficulties may result from ill-conditioned RIR matrices or from limited processing resources.

Figure 3:
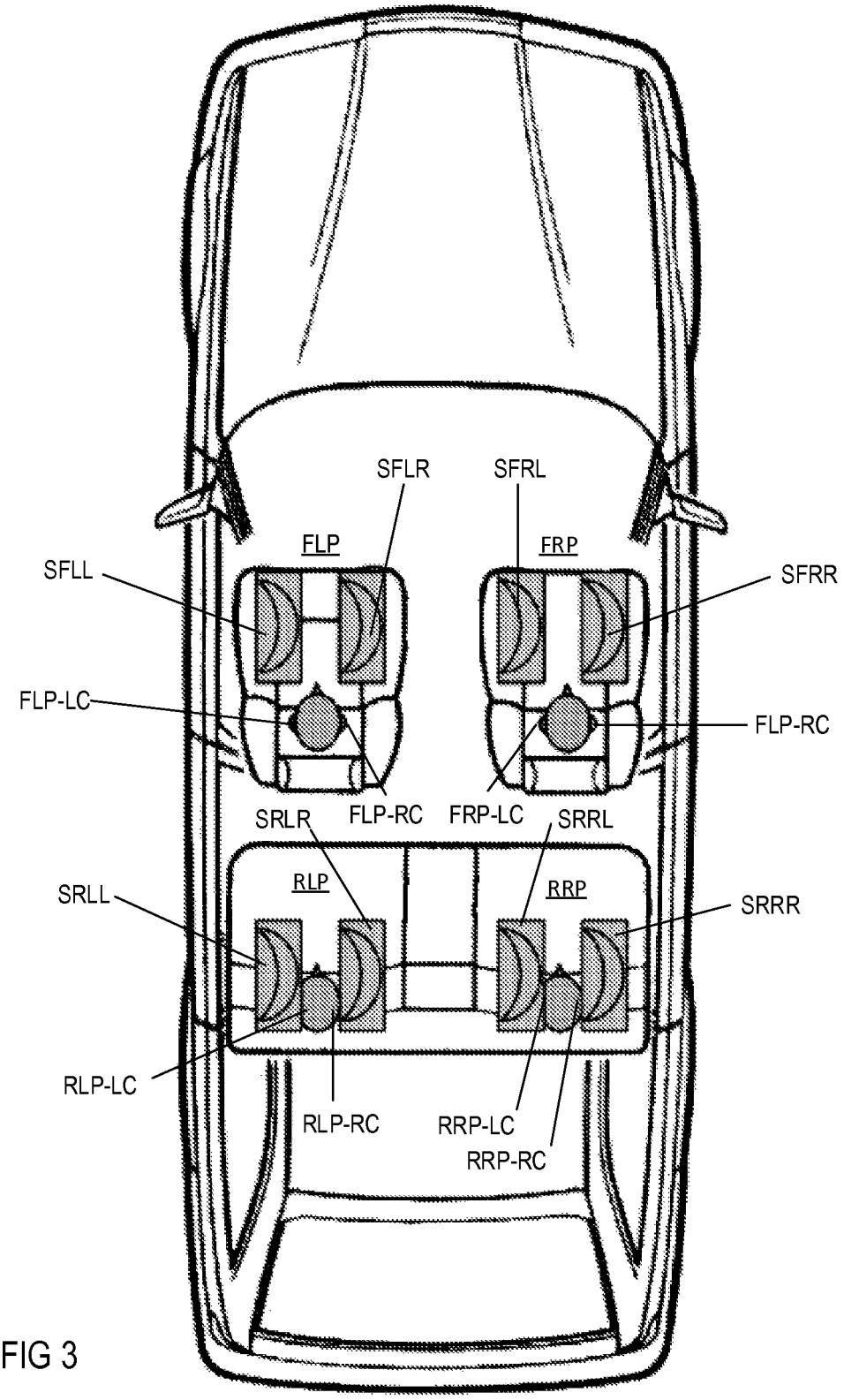
FIG. 3 is a schematic diagram illustrating a cabin of a car with four listening positions and stereo loudspeakers arranged around the listening position.

Referring now to FIG. 3, an exemplary 8×8 system may include four listening positions in a car cabin: front left listening position FLP, front right listening position FRP, rear left listening position RLP and a rear right listening position RRP. At each listening position FLP, FRP, RLP and RRP, a stereo signal with left and right channels shall be reproduced so that a binaural audio signal shall be received at each listening position: front left position left and right channels FLP-LC and FLP-RC, front right position left and right channels FRP-LC and FRP-RC, rear left position left and right channels RLP-LC and RLP-RC and rear right position left and right channels RRP-LC and RRP-RC. Each channel may include a loudspeaker or a group of loudspeakers of the same type or a different type, such as woofers, midrange loudspeakers and tweeters. For accurate measurement purposes, microphones (not shown) may be mounted in the positions of an average listener's ears when sitting in the listening positions FLP, FRP, RLP and RRP. In the present case, loudspeakers are disposed left and right (above) the listening positions FLP, FRP, RLP and RRP. In particular, two loudspeakers SFLL and SFLR may be arranged close to position FLP, two loudspeakers SFRL and SFRR close to position FRP, two loudspeakers SRLL and SRLR close to position RLP and two loudspeakers SRRL and SRRR close to position RRP. The loudspeakers may be slanted in order to increase crosstalk attenuation between the front and rear sections of the car cabin. The distance between the listener's ears and the corresponding loudspeakers may be kept as short as possible to increase the efficiency of the inverse filters.

Figure 4:
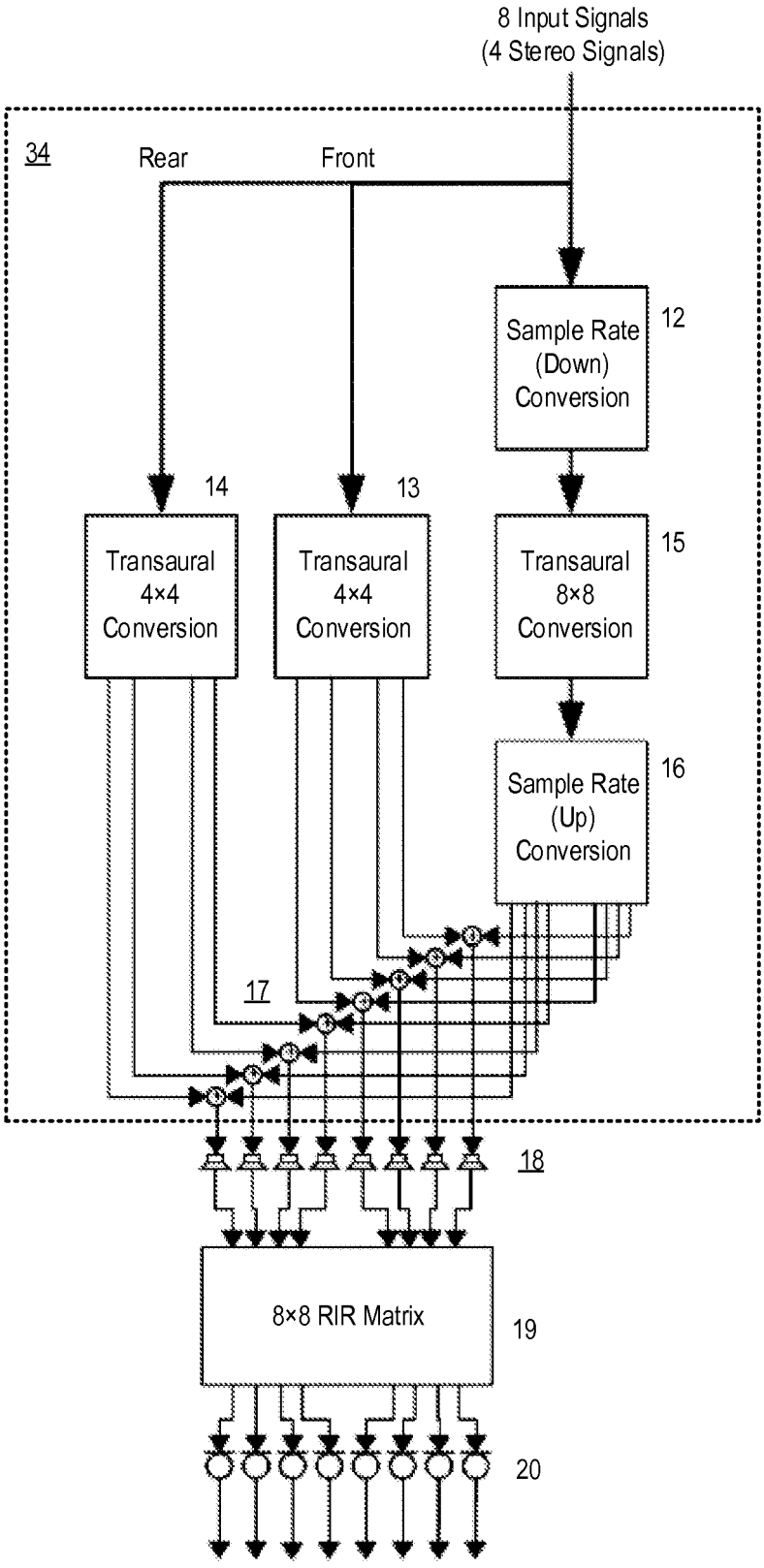
FIG. 4 is a block diagram illustrating an 8×8 processing arrangement including two 4×4 and one 8×8 inverse filter matrices.

FIG. 4 illustrates a processing system implementing a processing method applicable in connection with the loudspeaker arrangement shown in FIG. 3. The system has four stereo input channels, i.e., eight single channels. All eight channels are supplied to sample rate down-converter 12. Furthermore, the four front channel signals thereof, which are intended to be reproduced by loudspeakers SFLL, SFLR, SFRL and SFRR, are sup-plied to 4×4 transaural processing unit 13 and the four rear channel signals thereof, which are intended to be reproduced by loudspeakers SRLL, SRLR, SRRL and SRRR, are supplied to 4×4 transaural processing unit 14. The down-sampled eight channels are supplied to 8×8 transaural processing unit 15 and, upon processing therein, to sample rate up-converter 16. The processed signals of the eight channels of sample rate up-converter 16 are each added with the corresponding processed signals of the four channels of transaural processing unit 13 and the four channels of transaural processing unit 14 by way of an adding unit 17 to provide the signals reproduced by loudspeaker array 18 with loudspeakers SFLL, SFLR, SFRL, SFRR, SRLL, SRLR, SRRL and SRRR. These signals are transmitted according to RIR matrix 19 to microphone array 20 with eight microphones that represent the eight ears of the four listeners and that provide signals representing reception signals/channels FLP-LC, FLP-RC, FRP-LC, FRP-RC, RLP-LC, RLP-RC, RRP-LC and RRP-RC. Inverse filtering by 8×8 transaural processing unit 15, 4×4 transaural processing unit 13 and 4×4 transaural processing unit 14 is configured to compensate for RIR matrix 19 so that each of the sound signals received by the microphones of microphone array 20 corresponds to a particular one of the eight electrical audio signals input in the system, and the other reception sound signal corresponds to the other electrical audio signal.

In the system of FIG. 4, 8×8 transaural processing unit 15 is operated at a lower sampling rate than 4×4 transaural processing units 13 and 14 and with lower frequencies of the processed signals, by which the system is more resource efficient. The 4×4 transaural processing units 13 and 14 are operated over the complete useful frequency range and thus allow for more sufficient crosstalk attenuation over the complete useful frequency range compared to 8×8 transaural processing. In order to further improve the crosstalk attenuation at higher frequencies, directional loudspeakers may be used. As already outlined above, directional loudspeakers are loudspeakers that concentrate acoustic energy to a particular listening position. The distance between the listener's ears and the corresponding loudspeakers may be kept as short as possible to further increase the efficiency of the inverse filters. It has to be noted that the spectral characteristic of the regularization parameter may correspond to the characteristics of the channel under investigation.

Systems such as those described above in connection with FIGS. 3 and 4 work sufficiently when the actual position of a listener's head is identical with a reference head position used for the calculation of an ISZ filter matrix. However, in everyday situations the head position may significantly vary from the reference position. Due to this known "ambiguity problem" and the fact that methods for solving it, e.g. using time-varying all pass filter, half-wave rectification or the like, cannot be applied in acoustically equalized rooms, adaptive attempts cannot be applied to compensate for varying head positions. These limitations also apply to automotive environments. It is therefore desirable to link the individual sound zones to the actual head positions of the listeners in the car, e.g., for listeners on the driver and the passenger seats in the front, since particularly those seats dispose of manifold possibilities to be adjusted in different ways which lead to significant shifts of the actual head positions in respect to the reference head positions used for the calculation of an ISZ filter matrix and to a reduced damping performance experienced by the listener. In order to provide the listeners with the best possible damping performance, the ISZ filter matrix has to be adjusted to the current head positions. As already mentioned, this is not possible in an adaptive way, mainly due to the ambiguity problem.

Figure 5:
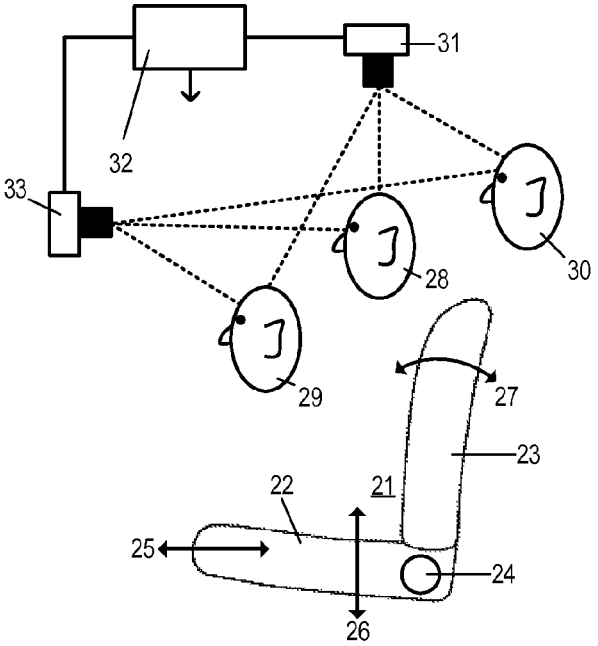
FIG. 5 is a schematic diagram illustrating a visual monitoring system that visually monitors the position of the listener's head relative to a reference listening position in a three dimensional space.

Referring to FIG. 5, a car front seat 21 that includes at least a seat portion 22 and a back portion 23 is moveable back and forth in a horizontal direction 25 and up and down in a vertical direction 26. Back portion 23 is linked to seat portion 22 via a rotary joint 24 and is tiltable back and forth along an arc line 27. As can be seen a multiplicity of seat constellations and, thus, a multiplicity of different head positions are possible, although only three positions 28, 29, 30 are shown in FIG. 5. With listeners of varying body heights even more head positions may be achieved. In order to track the head position along vertical direction 26 an optical sensor above the listener's head, e.g., a camera 31 with a subsequent video processing arrangement 32, tracks the current position of the listener's head (or listeners' heads in a multiple seat system), e.g., by way of pattern recognition. Optionally also the head position along vertical direction 26 may additionally be traced by a further optical sensor, e.g., camera 33, which is arranged in front of the listeners head. Both cameras 31 and 33 are arranged such that they are able to cap-ture all possible head positions, e.g., both cameras 31, 33 have a sufficient monitoring range or are able to perform a scan over a sufficient monitoring range. Instead of a cam-era, information of a seat positioning system or dedicated seat position sensors (not shown) may be used to determine the current seat position in relation to the reference seat position for adjusting the filter coefficients.

Figure 6:
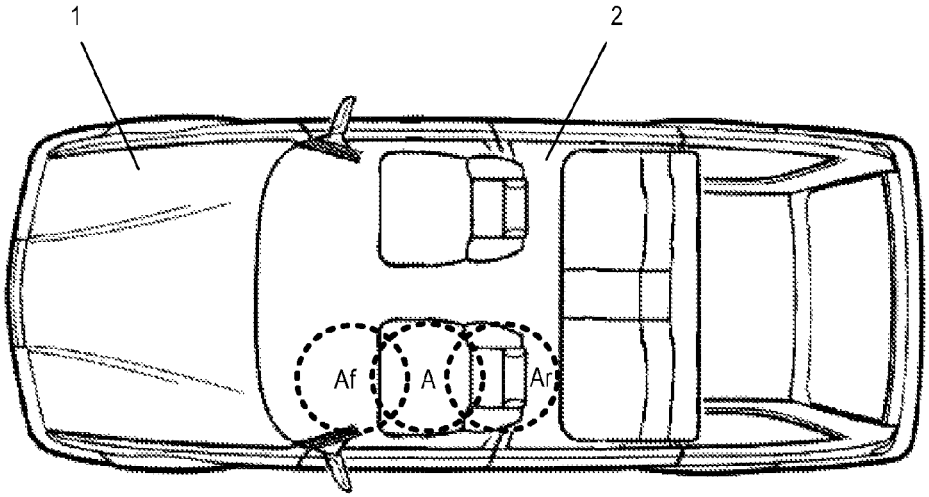
FIG. 6 is a schematic diagram illustrating the car cabin shown in FIG. 1 when a sound zone tracks the head position.

Referring again to FIG. 1, particularly to sound zone A which corresponds to a listening position at the driver's seat, the head of a particular listener or the heads of different listeners (e.g., zones A and B) may vary between different positions along the longitudinal axis of the car 1. An extreme front positions of a listener's head may be, for example, a front position Af and an extreme rear position may be rear position Ar. Reference position A is between positions Af and Ar as shown in FIG. 6. Information concerning the current position of the listener's head is used to adjust the characteristics of the at least one filter matrix which compensates for the transfer matrix. The characteristics of the filter matrix may be adjusted, for example, by way of lookup tables for transforming the current position into corresponding filter coefficients or by employing simultaneously at least two matrices representing two different sound zones, and fading between the at least two matrices dependent on the current head position.

Figure 7:
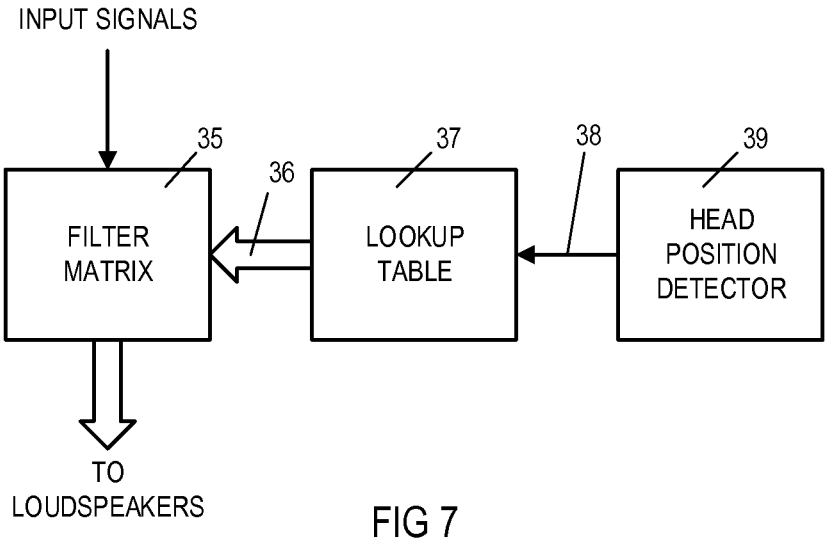
FIG. 7 is a schematic diagram illustrating a system with one filter matrix adjusted by way of a lookup table.

In a system that uses lookup tables for transforming the current position into corresponding filter coefficients, such as the system shown in FIG. 7, a filter matrix 35 for a particular listening position, such as the reference listening position corresponding to sound zone A in FIGS. 1 and 6, has specific filter coefficients to provide the desired sound zone at the desired position. The filter matrix 35 may be provided, for example, by a matrix filter system 34 as shown in FIG. 4 including the two transaural 4×4 conversion matrices 13 and 14, the transaural 8×8 conversion matrix 15 in connection with the sample rate down-converter 12 and the sample rate up-converter 16, and summing unit 17, or any other appropriate filter matrix. The characteristics of the filter matrix 35 are controlled by filter coefficients 36 which are provided by a lookup table 37. In the lookup table 37, for each discrete possible head position a corresponding set of filter coefficients for establishing the optimum sound zone at this position is stored. The respective set of filter coefficients is selected by way of a position signal 38 which represents the current head position and is provided by a head position detector 39 (such as, e.g. a camera 31 and video processing arrangement 32 in the system shown in FIG. 5).

Figure 8:
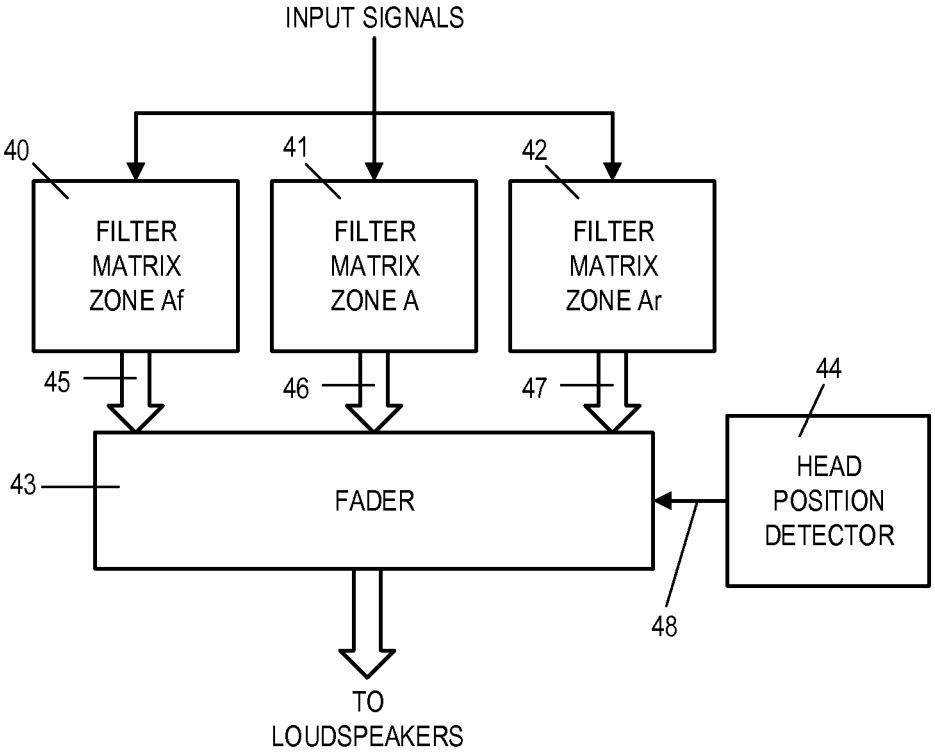
FIG. 8 is a schematic diagram illustrating a system with three filter matrices adjusted by way of a fader.

Alternatively, at least two filter matrices with fixed coefficients, e.g., three filter matrices 40, 41 and 42 as in the arrangement shown in FIG. 8, which correspond to the sound zones Af, A and Ar in the arrangement shown in FIG. 6, are operated simultaneously and their output signals 45, 46, 47 (to loudspeakers 18 in the arrangement shown in FIG. 4) are soft-switched on or off dependent on which one of the sound zones Af, A and Ar is desired to be active, or new sound zones are created by fading (including mixing and cross-fading) the signals of at least two fixed sound zones (at least three for three dimensional tracking) with each other. Soft-switching and fading are performed in a fader module 43. The respective two or more sound zones are selected by way of a position signal 48 which represents the current head position and is pro-vided by a head position detector 44. Soft-switching and fading generate no significant signal artifacts due to their gradual switching slopes.

Figure 9:
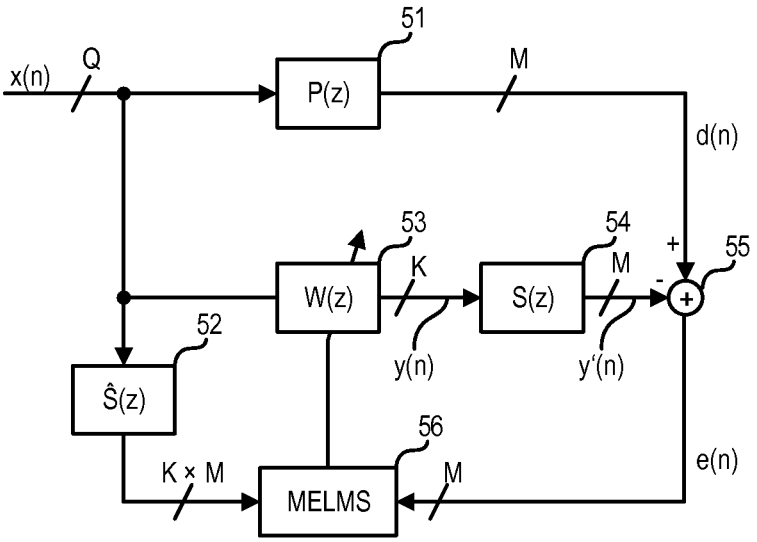
FIG. 9 is a flow chart illustrating a simple acoustic Multiple-Input Multiple-Output (MIMO) system with Q input signals (sources), M recording channels (microphones) and K output channels (loudspeakers), including a multiple error least mean square (MELMS) system or method.

Alternatively, a multiple-input multiple-output (MIMO) system as shown in FIG. 9 instead of an inverse-matrix system as described above may be used. The MIMO sys-tem may have a multiplicity of outputs (e.g., output channels for supplying output signals to K≥1 groups of loudspeakers) and a multiplicity of (error) inputs (e.g., recording channels for receiving input signals from M≥N≥1 groups of microphones, in which N is the number of sound zones). A group includes one or more loudspeakers or micro-phones that are connected to a single channel, i.e., one output channel or one recording channel. It is assumed that the corresponding room or loudspeaker-room-microphone system (a room in which at least one loudspeaker and at least one microphone is arranged) is linear and time-invariant and can be described by, e.g., its room acoustic impulse responses. Furthermore, Q original input signals such as a mono input signal x(n) may be fed into (original signal) inputs of the MIMO system. The MIMO system may use a multiple error least mean square (MELMS) algorithm for equalization, but may employ any other adaptive control algorithm such as a (modified) least mean square (LMS), recursive least square (RLS), etc. Input signal x(n) is filtered by M primary paths 101, which are represented by primary path filter matrix P(z) on its way from one loudspeaker to M microphones at different positions, and provides M desired signals d(n) at the end of primary paths 51, i.e., at the M microphones.

By way of the MELMS algorithm, which may be implemented in a MELMS processing module 506, a filter matrix W(z), which is implemented by an equalizing filter module 53, is controlled to change the original input signal x(n) such that the resulting K output signals, which are supplied to K loudspeakers and which are filtered by a filter module 54 with a secondary path filter matrix S(z), match the desired signals d(n). Accordingly, the MELMS algorithm evaluates the input signal x(n) filtered with a secondary pass filter matrix $\hat{S}(z)$, which is implemented in a filter module 52 and outputs K×M filtered input signals, and M error signals e(n). The error signals e(n) are provided by a subtractor module 55, which subtracts M microphone signals y'(n) from the M desired signals d(n). The M recording channels with M microphone signals y'(n) are the K output channels with K loudspeaker signals y(n) filtered with the secondary path filter matrix S(z), which is implemented in filter module 54, representing the acoustical scene. Modules and paths are understood to be at least one of hardware, software and/or acoustical paths.

The MELMS algorithm is an iterative algorithm to obtain the optimum least mean square (LMS) solution. The adaptive approach of the MELMS algorithm allows for in situ design of filters and also enables a convenient method to readjust the filters whenever a change occurs in the electro-acoustic transfer functions. The MELMS algorithm employs the steepest descent approach to search for the minimum of the performance index. This is achieved by successively updating filters' coefficients by an amount proportional to the negative of gradient $\underline{\nabla}(n)$, according to which $\underline{w}(n+1)=\underline{w}(n)+\mu(-\underline{\nabla}(n))$, where μ is the step size that controls the convergence speed and the final misadjustment. An approximation may be in such LMS algorithms to update the vector $\underline{w}$ using the instantaneous value of the gradient $\underline{\nabla}(n)$ instead of its expected value, leading to the LMS algorithm.

Figure 10:
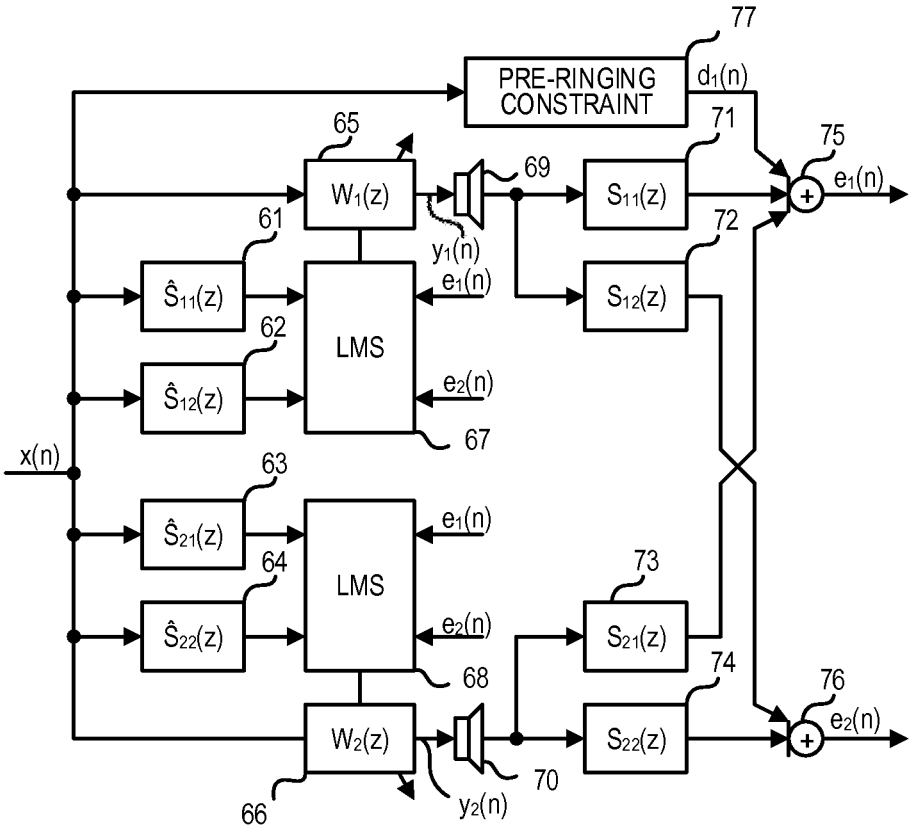
FIG. 10 is a flowchart illustrating a 1×2×2 MELMS system applicable in the MIMO system shown in FIG. 9.

FIG. 10 is a signal flow chart of an exemplary Q×K×M MELMS system, wherein Q is 1, K is 2 and M is 2 and which is adjusted to create a bright zone at microphone 75 and a dark zone at microphone 76; i.e., it is adjusted for individual sound zone purposes. A "bright zone" represents an area where a sound field is generated in contrast to an almost silent "dark zone". Input signal x(n) is supplied to four filter modules 61-64, which form a 2×2 secondary path filter matrix with transfer functions $\hat{S}11(z)$, $\hat{S}12(z)$, $\hat{S}21(z)$ and $\hat{S}22(z)$, and to two filter modules 65 and 66, which form a filter matrix with transfer functions W1(*z*) and W2(*z*). Filter modules 65 and 66 are controlled by least mean square (LMS) modules 67 and 68, whereby module 67 receives signals from modules 61 and 62 and error signals e1(*n*) and e2(*n*), and module 68 receives signals from modules 63 and 64 and error signals e1(*n*) and e2(*n*). Modules 65 and 66 provide signals y1(*n*) and y2(*n*) for loudspeakers 69 and 70. Signal y1(*n*) is radiated by loud-speaker 69 via secondary paths 71 and 72 to microphones 75 and 76, respectively. Signal y2(*n*) is radiated by loudspeaker 70 via secondary paths 73 and 74 to microphones 75 and 76, respectively. Microphone 75 generates error signals e1(*n*) and e2(*n*) from received signals y1(*n*), y2(*n*) and desired signal d1(*n*). Modules 61-64 with transfer functions $\hat{S}11(z)$, $\hat{S}12(z)$, $\hat{S}21(z)$ and $\hat{S}22(z)$ model the various secondary paths 71-74, which have transfer functions S11(*z*), S12(*z*), S21(*z*) and S22(*z*).

Optionally, a pre-ringing constraint module 77 may supply to microphone 75 an electrical or acoustic desired signal d1(*n*), which is generated from input signal x(n) and is added to the summed signals picked up at the end of the secondary paths 71 and 73 by microphone 75, eventually resulting in the creation of a bright zone there, whereas such a desired signal is missing in the case of the generation of error signal e2(*n*), hence resulting in the creation of a dark zone at microphone 76. In contrast to a modeling delay, whose phase delay is linear over frequency, the pre-ringing constraint is based on a non-linear phase over frequency in order to model a psychoacoustic property of the human ear known as pre-masking. "Pre-masking" threshold is understood herein as a constraint to avoid pre-ringing in equalizing filters.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A sound system for acoustically reproducing electrical audio signals and establishing sound zones, in each of which reception sound signals occur that provide an individual pattern of the reproduced and transmitted electrical audio signals, the system comprising:

a signal processing arrangement that is configured to process the electrical audio signals to provide processed electrical audio signals;

groups of loudspeakers that are arranged at positions separate from each other and within or adjacent to the sound zones, each of the groups of loudspeakers is configured to convert the processed electrical audio signals into corresponding acoustic audio signals; and a monitoring system configured to monitor a position of a listener's head relative to a reference listening position; wherein:

each of the acoustic audio signals is transferred according to a transfer matrix from each of the groups of loudspeakers to each of the sound zones to contribute to the reception sound signals, processing of the electrical audio signals comprises filtering that is configured to compensate for the transfer matrix so that each of the reception sound signals corresponds to one of the electrical audio signals, and filter characteristics of the filtering are adjusted based on an identified listening position of the listener's head, where the monitoring system is a visual monitoring system configured to visually monitor the position of the listener's head relative to the reference listening position, where the monitoring system includes:

a first camera positioned above of the listener's head to monitor the position of the listener's head along a first direction, and a second camera positioned in front of the listener's head to monitor the position of the listener's head along a second direction, and where first direction is perpendicular to the second direction.

2. The system of claim 1, further comprising:

at least one filter matrix that includes filter coefficients that determines filter characteristics of the filter matrix; and a lookup table configured to transform the monitored position of the listener's head into filter coefficients that represent a sound zone around the monitored position of the listener's head.

3. The system of claim 1, further comprising:

at least one multiple-input multiple-output system that includes filter coefficients that determine filter characteristics of the multiple-input multiple-output system; and a lookup table configured to transform the monitored position of the listener's head into filter coefficients that represent a sound zone around the monitored position of the listener's head.

4. The system of claim 1, further comprising:

at least one filter matrix that includes at least two filter matrices that have different characteristics corresponding to different sound zones; and a fader that is configured to fade, cross-fade, mix or soft-switch between the at least two filter matrices that have different characteristics.

5. The system of claim 1, further comprising:

at least one multiple-input multiple-output system that includes at least two multiple-input multiple-output systems that have different characteristics corresponding to different sound zones; and a fader that is configured to fade, cross-fade, mix or soft-switch between the at least two multiple-input multiple-output systems that have different characteristics.

6. The system of claim 5, wherein the fader is configured to fade, cross-fade, mix or soft-switch such that no audible artifacts are generated.

7. The system of claim 1, further comprising a video signal processing module that is configured to recognize patterns in pictures represented by video signals.

8. A method for acoustically reproducing electrical audio signals and establishing sound zones, in each of which one of reception sound signal occurs that is an individual pattern of the reproduced and transmitted electrical audio signals, the method comprising:

processing the electrical audio signals to provide processed electrical audio signals; and converting the processed electrical audio signals into corresponding acoustic audio signals with groups of loudspeakers that are arranged at positions separate from each other and within or adjacent to the sound zones;

visually monitoring a listening position of a listener's head relative to a reference listening position; where each of the acoustic audio signals is transferred according to a transfer matrix from each of the groups of loudspeakers to each of the sound zones to contribute to the reception sound signals;

processing of the electrical audio signals comprises filtering that is configured to compensate for the transfer matrix so that each one of the reception sound signals corresponds to one of the electrical audio signals;

adjusting filtering characteristics of the filtering based on an identified listening position of the listener's head;

positioning a first camera above the listener's head to monitor a position of the listener's head along a first direction, and positioning a second camera in front of the listener's head to monitor a position of the listener's head along a second direction, where first direction is perpendicular to the second direction.

9. The method of claim 8, further comprising:

providing at least one filter matrix that includes filter coefficients that determine the filter characteristics of the filter matrix; and using a lookup table configured to transform the monitored position of the listener's head into filter coefficients that represent a sound zone around the monitored position of the listener's head.

10. The method of claim 8, further comprising:

providing at least one multiple-input multiple-output system that includes filter coefficients that determine the filter characteristics of the multiple-input multiple-output system; and using a lookup table that is configured to transform the monitored position of the listener's head into filter coefficients that represent a sound zone around the monitored position of the listener's head.

11. The method of claim 8, further comprising:

providing at least two filter matrices that have different characteristics corresponding to different sound zones; and fading, cross-fading, mix or soft-switching between the at least two filter matrices that have different characteristics, where fading, cross-fading, mixing or soft-switching is configured such that no audible artifacts are generated.

12. The method of claim 8, further comprising:

providing at least two multiple-input multiple-output systems that have different characteristics corresponding to different sound zones; and fading, cross-fading, mix or soft-switching between the at least two multiple-input multiple-output systems that have different characteristics, where fading, cross-fading, mixing or soft-switching is configured such that no audible artifacts are generated.

13. The method of claim 8, further comprising recognizing patterns in pictures represented by video signals.

14. A sound system for acoustically reproducing electrical audio signals and establishing sound zones, in each of which reception sound signals occur that provide an individual pattern of the reproduced and transmitted electrical audio signals, the system comprising:

a signal processing arrangement that is configured to process the electrical audio signals to provide processed electrical audio signals;

groups of loudspeakers that are arranged at different positions from each other and within or adjacent to the sound zones, each of the groups of loudspeakers is configured to convert the processed electrical audio signals into corresponding acoustic audio signals; and wherein each of the acoustic audio signals is transferred according to a transfer matrix from each of the groups of loudspeakers to each of the sound zones, wherein the processing of the electrical audio signals includes filtering to compensate for the transfer matrix so that each of the reception sound signals correspond to one of the electrical audio signals, and wherein filter characteristics of the filtering are adjusted based on an identified listening position of a listener's head, wherein the system further comprises a monitoring system that includes:

a first camera positioned above of a listener's head to monitor the position of the listener's head along a first direction, and a second camera positioned in front of the listener's head to monitor the position of the listener's head along a second direction, and where first direction is perpendicular to the second direction.

15. The system of claim 14, further comprising:

at least one filter matrix that includes filter coefficients that determine filter characteristics of the filter matrix; and a lookup table configured to transform the monitored position of the listener's head into filter coefficients that represent a sound zone around the monitored position of the listener's head.

16. The system of claim 14, further comprising:

at least one multiple-input multiple-output system that includes filter coefficients that determine filter characteristics of the multiple-input multiple-output system; and a lookup table configured to transform the monitored position of the listener's head into filter coefficients that represent a sound zone around the monitored position of the listener's head.

17. The system of claim 14, further comprising:

at least one filter matrix that includes at least two filter matrices that have different characteristics corresponding to different sound zones; and a fader that is configured to fade, cross-fade, mix or soft-switch between the at least two filter matrices that have different characteristics.

* * * * *